US007454857B1

(12) United States Patent
Monjello

(10) Patent No.: US 7,454,857 B1
(45) Date of Patent: Nov. 25, 2008

(54) OCCASION KEEPSAKE DISPLAY

(75) Inventor: Donald Monjello, Long Beach, NY (US)

(73) Assignee: Milestone Creations, LLC, Long Beach, NY (US)

( * ) Notice: Subject to any disclaimer, the term of this patent is extended or adjusted under 35 U.S.C. 154(b) by 227 days.

(21) Appl. No.: 11/260,338

(22) Filed: Oct. 27, 2005

(51) Int. Cl.
*A47G 1/06* (2006.01)

(52) U.S. Cl. ..... 40/722; 40/800

(58) Field of Classification Search ..... 40/722, 40/737, 781, 800, 661
See application file for complete search history.

(56) References Cited

U.S. PATENT DOCUMENTS 3,703,045 A * 11/1972 Nyman ..... 40/720
4,173,667 A * 11/1979 Rusch ..... 428/11
4,224,364 A * 9/1980 Hunt ..... 428/11
5,197,213 A * 3/1993 Borden ..... 40/737

* cited by examiner

*Primary Examiner*—Joanne Silbermann
(74) *Attorney, Agent, or Firm*—Carmody & Torrance LLP

(57) ABSTRACT

A multipiece keepsake display comprising a shell, the shell being at least partially transparent and having an open side that provides access to an interior region; a sealing plate for sealing the open side of the shell; a display plate that is at least partially transparent, the display plate being mountable to at least one of the shell and the sealing plate; wherein a first item is enclosable within the interior region of the shell by the sealing plate being sealed to the open side of the shell and a second item is enclosable intermediate the sealing plate and the display plate when the display plate is mounted to at least one of the shell and the sealing plate; whereby the first item is viewable through the transparent portion of the shell and the second item is viewable through the display plate. A method of constructing a keepsake display is also provided.

11 Claims, 4 Drawing Sheets

OCCASION KEEPSAKE DISPLAY

BACKGROUND OF THE INVENTION

The present invention relates generally to keepsake displays, and in particular, to an improved multipiece keepsake display that provides for an increased displayability of items and an increased viewing and remembrance pleasure.

Keepsake displays are well known. The closest known keepsake device is illustrated in FIG. 1. Specifically, the keepsake display of FIG. 1 comprises a shell 10 having a cavity 12 into which, in the preferred embodiment, ashes of a deceased loved one are placed. A plug, cap or cover (not shown) can be screwed on or otherwise secured to the cavity to ensure that the ashes do not undesirably leave cavity 12. As part of the remembrance component of the display, shell 10 is provided with a flat face 14 to which a frame 16 or other plate may be secured. In the contemplated construction, a photograph of the deceased loved one is placed behind frame 16, and then frame 16 is secured, with tape, glue or other adhesive material, to face 14. The photograph (not shown) is preferably secured with tape, glue or the like to the back of frame 16. The fully constructed display may then be positioned on a shelf table or other viewing area. The display may be positioned so that cavity 12 is on the bottom (e.g. out of view) or on the top, as a matter of design choice.

The display of FIG. 1 has several perceived deficiencies. For example, in that shell 10 only provided with a small cavity, such as cavity 12, the display is extremely limited in what can be placed in shell 10. Moreover, shell 10 is preferably opaque so as to eliminate the ability of actually viewing the ashes placed inside. Thus the viewability of what is in cavity 12 is eliminated.

It is therefore believed that additional advantages in a keepsake display are desired.

For example, it is desirable to provide a keepsake display primarily (although not necessarily) for more joyous occasions, whereby items that one wishes to make viewable are enclosable in a transparent shell portion. Secondly, recognizing that more of the interior of the shell can be utilized for the display of one or more items allows for an increased versatility as to what can be placed therein. With the aforementioned being just two of the objectives set forth herein, an improved enclosure arrangement is achievable and believed to be provided by the present invention.

It is thus believed that the present invention overcomes the perceived deficiencies in the prior art noted above and further achieves the aforementioned and below mentioned objectives.

SUMMARY AND OBJECTIVES OF THE INVENTION

Accordingly, it is an objective of the present invention to provide a multipiece keepsake display that provides for two viewable enclosures, one to receive one or more items such as a keepsake item (e.g. flowers, Broken Glass, Invitation, ETC.) and the other to receive another item, such as (but not necessarily) a photograph.

Another object of the present invention is to provide a keepsake display that provides for increased viewing and remembrance pleasure to the owner or viewer thereof.

Yet another object of the present invention is to provide a method of constructing an improved keepsake display that provides all of the advantages set forth herein. Still other objects and advantages of the invention will in part be obvious and will in part be apparent from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an improved multipiece keepsake display is provided. In a first embodiment, the display comprises a shell, the shell being at least partially transparent and having an open side that provides access to an interior region; a sealing plate for sealing the open side of the shell; a display plate that is at least partially transparent, the display plate being mountable to at least one of the shell and the sealing plate; wherein a first item is enclosable within the interior region of the shell by the sealing plate being sealed to the open side of the shell and a second item is enclosable intermediate the sealing plate and the display plate when the display plate is mounted to at least one of the shell and the sealing plate; whereby the first item is viewable through the transparent portion of the shell and the second item is viewable through the display plate.

In another embodiment, a method of constructing the keepsake display is provided and comprises the steps of placing a first item within the interior region of the shell and enclosing it therein by sealing the sealing plate to the open side of the shell; and placing a second item intermediate the sealing plate and the display plate and enclosing it therebetween by mounting the display plate to at least one of the shell and the sealing plate; wherein the first item is viewable through the transparent portion of the shell and the second item is viewable through the display plate.

In yet an alternative embodiment, the method comprises the steps of placing a first item within the interior region of the shell and enclosing it therein by placing the enclosing plate against the open side of the shell; and placing a second item intermediate the enclosing plate and the display plate and enclosing it therebetween by securing the display plate to the shell; wherein the first item is viewable through the transparent portion of the shell and the second item is viewable through the display plate. Of course, in a specific embodiment, the method may comprise the step of sealing the enclosing plate to the shell.

BRIEF DESCRIPTION OF THF DRAWINGS

For a fuller understanding of the invention, reference is had to the following description taken in connection with the accompanying figures, in which.

Identically numbered elements in the various figures are intended to designate like elements, although not every element in every figure is so labeled.

DETAILED DESCRIPTION OF THE PREFERRED EMBODIMENTS

Figure 1:
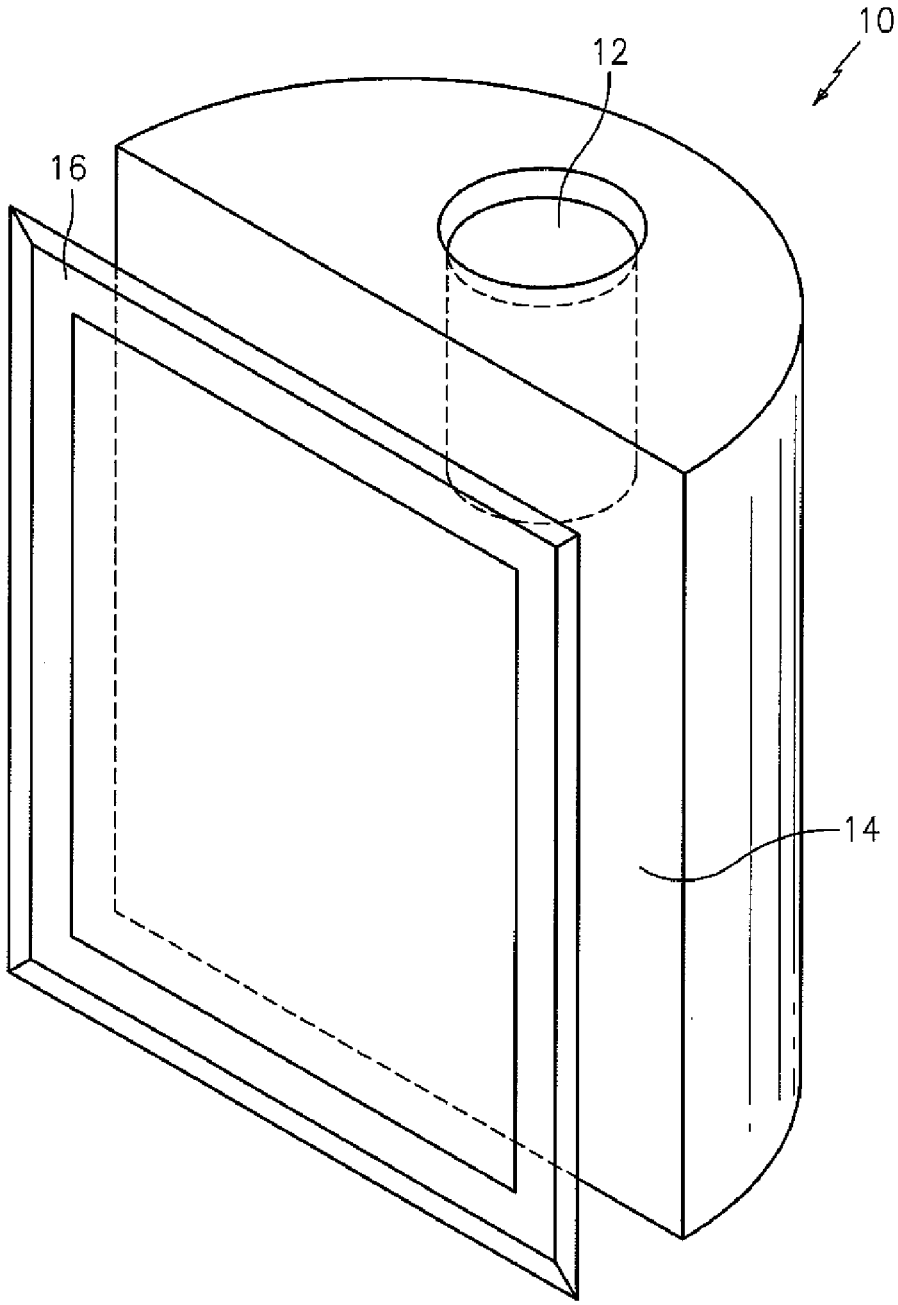
FIG. 1 (PRIOR ART)
FIG. 1 is a perspective view of a keepsake display constructed in accordance with the prior art.
Figure 2:
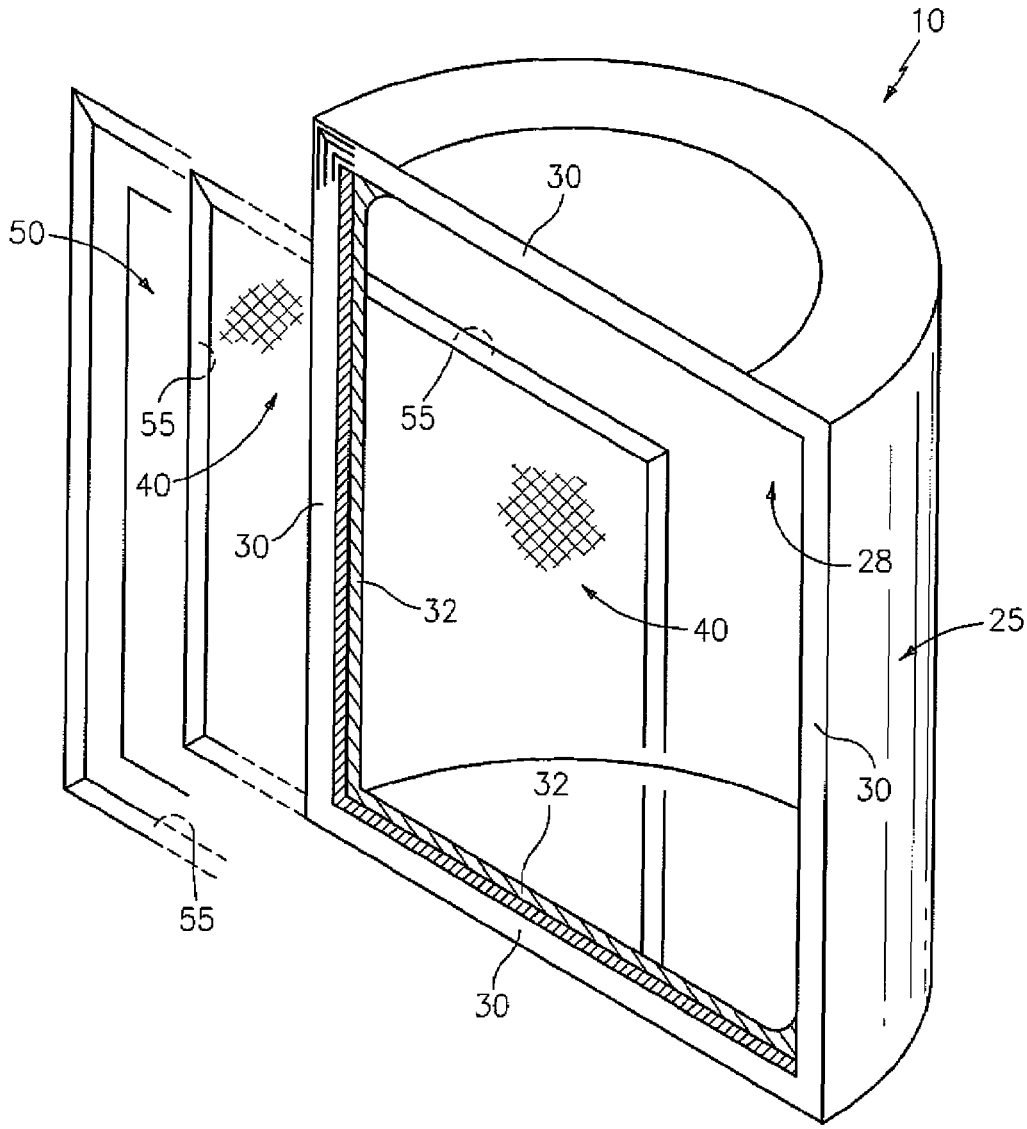
FIG. 2 is an exploded view of a multipiece keepsake display constructed in accordance with the present invention.
Figure 3:
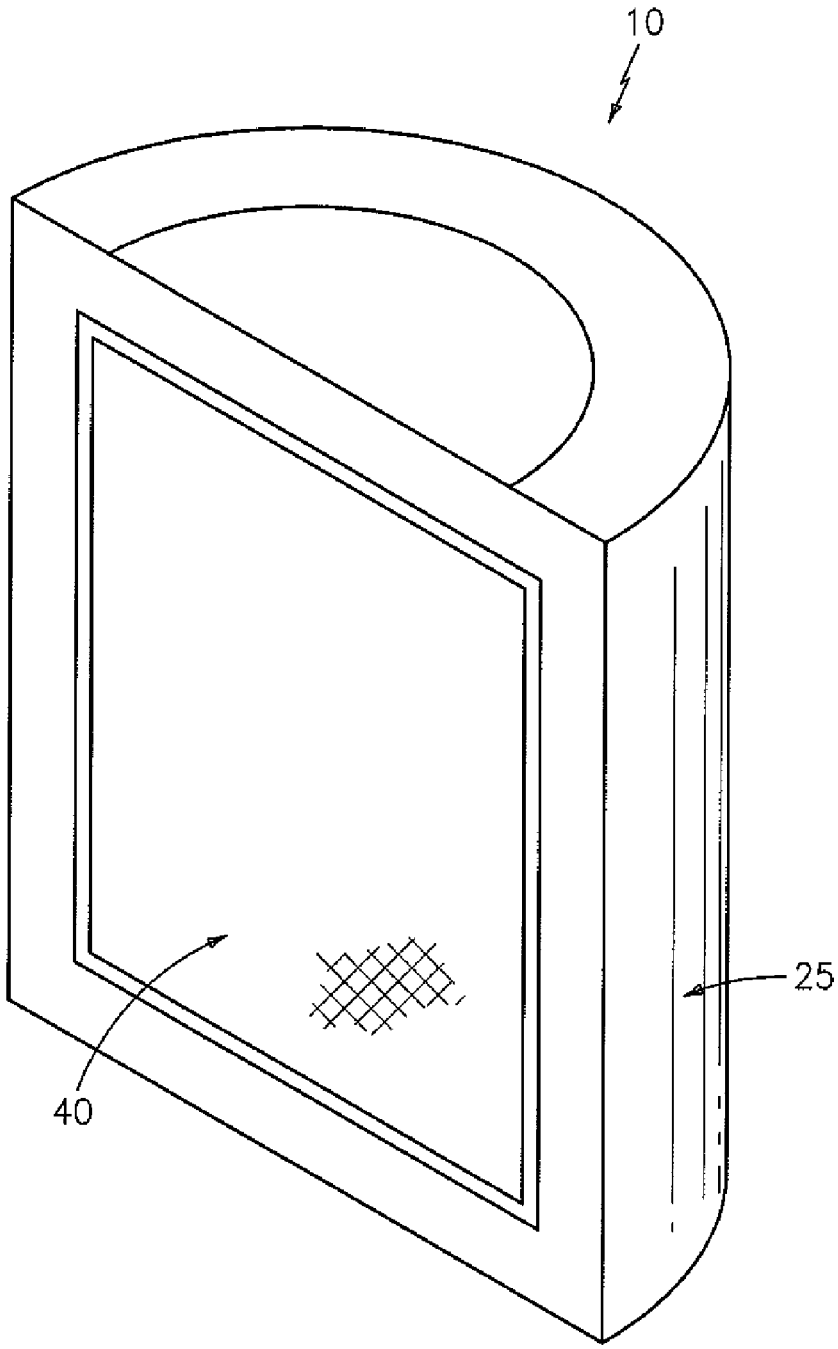
FIG. 3 is a perspective view of a partially constructed multipiece keepsake display in accordance with the present invention.
Figure 4:
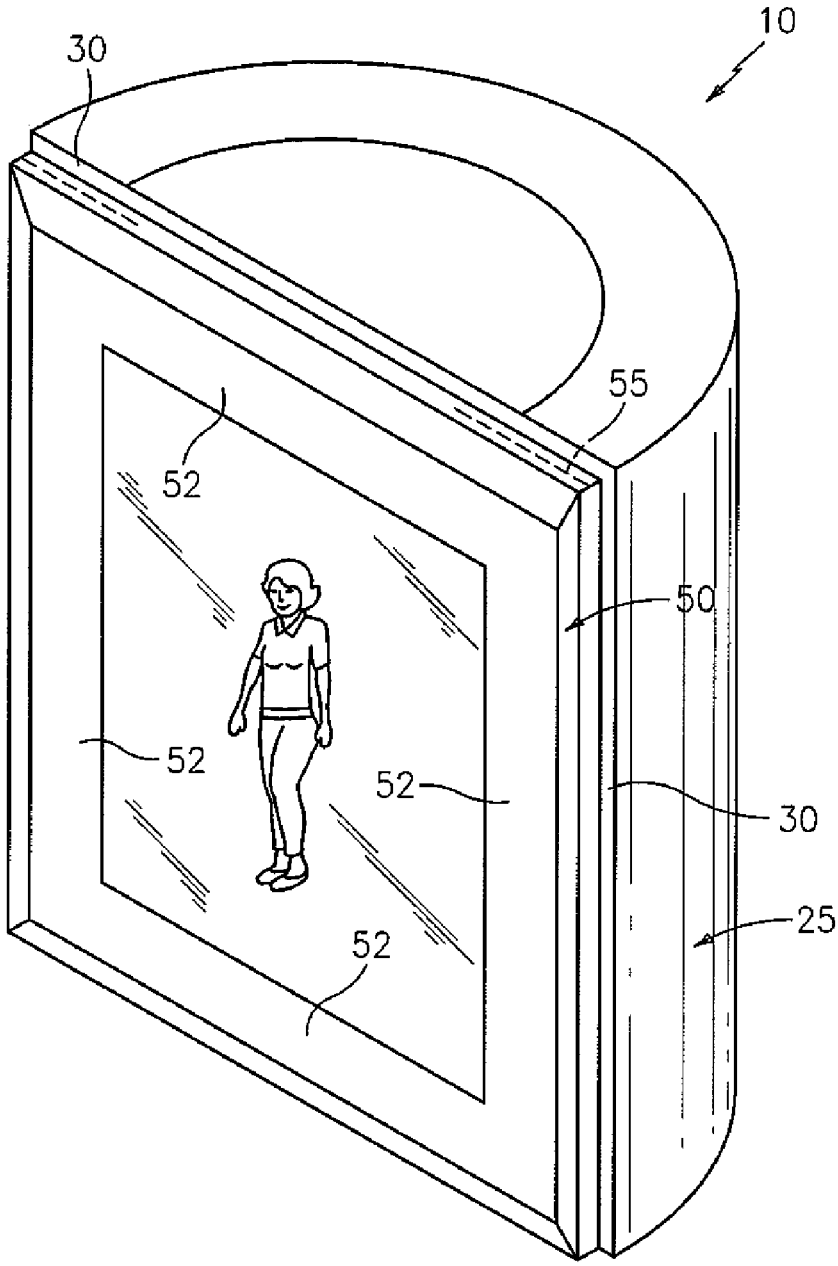
FIG. 4 is a perspective view of a completed multipiece keepsake display constructed in accordance with the present invention.

Reference is now made to FIGS. 2-4, which show a multipiece keepsake display, generally indicated at 20, constructed in accordance with the present invention.

In a preferred embodiment, multipiece keepsake display 10 ("display 10") comprises a shell generally indicated at 25, which is at least partially (and in the preferred embodiment, fully) transparent. Shell 25 has an open side that provides access to an interior region 28. In the preferred embodiment, shell 25 is made of glass or hard plastic. Shell 25 includes a front face 30 that circumscribes all four sides thereof, and also includes a recessed ledge 32 that circumscribes the open side of shell 25.

Display 20 also comprises a sealing plate, generally indicated at 40, for sealing the open side of the shell. Specifically, and as illustrated in FIG. 3, sealing plate 40 is dimensioned to sit on recessed ledge 32 when sealed to the open side of shell 25 so that sealing plate 40 lies essentially (if not fully) flush with front face 30 when seated on and sealed (as set forth below) to recessed ledge 32.

Display 20 also comprises a display plate 50 that is at least partially transparent (i.e. made of clear plastic or glass). Display plate 50 is preferably mountable to the front face 30 of shell 25, but can also be mounted to sealing plate 40 (or both to plate 40 and front face 30). For increased aesthetics, display plate 50 may include a border 52 (FIG. 4) circumscribed therearound for "framing" the item (e.g. a photograph) that is enclosed intermediate display plate 50 and sealing plate 40.

As can now be seen by the completed display assembly in FIG. 4, a first item (e.g. flowers, broken glass or invitation, etc.) is enclosable within interior region 28 of shell 25 by sealing plate 40 being sealed to the open side of shell 25 (FIG. 3) and a second item (e.g. a photograph) is enclosable intermediate sealing plate 40 and display plate 50 when display plate 50 is mounted to the shell (e.g. the front face 30) and/or sealing plate 40. Again, it is preferred that display plate 50 is mounted to front face 30 but it is also within the scope of the invention to additionally (or alternatively) mount display plate 50 to sealing plate 40. In this completed way, the first item is viewable through the transparent portion of shell 25 and the second item is viewable through display plate 50 (FIG. 4).

The preferred means for sealing sealing plate 40 to recessed ledge 32 of shell 25 is double-sided tape 55, but this is only by example as the skilled artisan will quickly realize that other means of sealing are well within the scope of the invention (e.g. glue, Velcro, or the like). Even a latch arrangement is within the scope of the invention. Preferably however, whatever is used permits sealing plate 40 to lie flush with front face 30 when positioned on ledge 32.

Similarly, the preferred means for mounting display plate 50 to front face 30 of shell 25 when sealing plate 40 is seated on recessed ledge 32 is double sided tape 55, which may be provided all the way around the outside (backside) edge of plate 50.

As should thus be understood from the foregoing, a method of constructing a keepsake display is also provided. In the preferred embodiment, the method comprises placing a first item (e.g. flowers, Broken Glass or Invitation) within interior region 28 of shell 25 and enclosing it therein by sealing sealing plate 40 to the open side of the shell (e.g. on ledge 32) and placing a second item intermediate sealing plate 40 and display plate 50 and enclosing it therebetween by mounting display plate 50 to the shell (e.g. front face 30) and/or sealing plate 40. Again, the preferred (but not only) embodiment provides that display plate 50 is secured to front face 30. In this way, the first item is viewable through the transparent portion of the shell and the second item is viewable through display plate 50. The first item may be placed or secured (by gluing or otherwise) within interior region 28 while the second item (e.g. the photo) is preferably glued or taped to the backside of plate/frame 50.

As set forth above, in the embodiment where shell 25 includes front face 30, recessed ledge 32 circumscribes the open side thereof and sealing plate 40 is dimensioned to sit on recessed ledge 32, the method also comprises the step of seating sealing plate 40 on recessed ledge 32 (FIG. 3) and sealing sealing plate 40 to the shell (e.g. such as by tape, glue or the like). In this way, sealing plate 40 will preferably lie at least essentially (if not fully) flush with front face 32 when seated on and sealed to the recessed ledge.

Preferably, but not necessarily thereafter, display plate 50 is mounted to the front face of the shell when sealing plate 40 is seated on the recessed ledge (FIG. 4).

Lastly, while the foregoing embodiments are most preferred, it should be understood that that the present invention also comprises a method of constructing a keepsake display wherein it is only display plate 50 that is secured to shell 25. That is, in this alternative embodiment, sealing plate 40 may be replaced by a functionally equivalent enclosing plate 40 which is merely mountable against the open side of the shell for enclosing an item in interior region 28. In this embodiment, the method comprises the steps of placing a first item within the interior region of the shell and enclosing it therein by placing enclosing plate 40 against the open side of the shell; and placing a second item intermediate enclosing plate 40 and display plate 50 and enclosing it therebetween by securing the display plate to the shell. That is, the only difference between the first and second methodologies is the appreciation that enclosing plate 40 is not required to be (but is in fact preferably) sealed to close the open side of the shell. Thus a multipiece keepsake display with the aforementioned construction is also provided hereby. Here too, any securing of the enclosing plate 40 or display plate 50 to the shell is preferably done with double-sided tape.

It can thus be seen that the present invention provides numerous advantages not found in the prior art. For example, the present invention provides an improved multipiece keepsake display that provides for two viewable enclosures, one to receive one or more items such as a keepsake item (e.g. flowers, broken glass, invitation, etc.) and the other to receive another item, such as a photograph. The present invention also provides a display (and method of making it) that provides for increased pleasure to the owner or viewer thereof.

While the invention has been particularly shown and described with respect to preferred embodiments thereof, it will be understood by those skilled in the art that changes in form and details may be made therein without departing from the scope and spirit of the invention. For example, the present invention has been disclosed by way of example as having a rectangular open side. However, other shapes for the open side are contemplated hereby.

What is claimed is:

1. A multipiece keepsake display comprising:

a shell, the shell being at least partially transparent and having an open side that provides access to an interior region, wherein the shell further includes a front face and a recessed ledge circumscribing the open side of the shell;

a sealing plate for sealing the open side of the shell and wherein the sealing plate is dimensioned to sit on the recessed ledge when sealed to the open side of the shell, wherein the sealing plate lies essentially flush with the front face when seated on and sealed to the recessed ledge;

a display plate that is at least partially transparent, the display plate being mountable directly to at least one of the shell and the sealing plate;

wherein:

a first item is enclosable within the interior region of the shell by the sealing plate being sealed to the open side of the shell and a second item is enclosable intermediate the sealing plate and the display plate when the display plate is mounted to at least one of the shell and the sealing plate;

whereby:

the first item is viewable through the transparent portion of the shell and the second item is viewable through the display plate.

2. The multipiece keepsake display as claimed in claim 1, including sealing means for sealing the sealing plate to the recessed ledge of the shell.

3. The multipiece keepsake display as claimed in claim 1, including mounting means for mounting the display plate to the front face of the shell when the sealing plate is seated on the recessed ledge.

4. The multipiece keepsake display as claimed in claim 3, wherein the display plate includes a border for framing the second item that is enclosed intermediate the display plate and the sealing plate.

5. The multipiece keepsake display as claimed in claim 1, wherein the second item is a photograph.

6. A method of constructing a keepsake display comprising a shell being at least partially transparent and having an open side that provides access to an interior region, a sealing plate for sealing the open side of the shell and a display plate that is at least partially transparent and being mountable to at least one of the shell and the sealing plate, wherein the shell includes a front face and a recessed ledge circumscribing the open side of the shell and wherein the sealing plate is dimensioned to sit on the recessed ledge when sealed to the open side of the shell, wherein the method comprises the step of:

placing a first item within the interior region of the shell and enclosing it therein by seating the sealing plate on the recessed ledge and sealing the sealing plate to the open side of the shell, wherein the sealing plate lies essentially flush with the front face when seated on and sealed to the recessed ledge; and placing a second item intermediate the sealing plate and the display plate and enclosing it therebetween by mounting the display plate directly to at least one of the shell and the sealing plate;

wherein the first item is viewable through the transparent portion of the shell and the second item is viewable through the display plate.

7. The method of constructing the keepsake display as claimed in claim 6, including the step of mounting the display plate to the front face of the shell when the sealing plate is seated on the recessed ledge.

8. The method as claimed in claim 6, wherein the second item is a photograph.

9. A method of constructing a keepsake display comprising a shell being at least partially transparent and having an open side that provides access to an interior region, an enclosing plate mountable against the open side of the shell for enclosing an item in the interior region and a display plate that is at least partially transparent and being securable to the shell, wherein the shell includes a front face and a recessed ledge circumscribing the open side of the shell and wherein the enclosing plate is dimensioned to sit on the recessed ledge when mounted against the open side of the shell, wherein the method comprises the steps of:

placing a first item within the interior region of the shell and enclosing it therein by placing the enclosing plate against the open side of the shell and seating the enclosing plate on the recessed ledge so that the enclosing plate lies essentially flush with the front face when seated on the recessed ledge; and placing a second item intermediate the enclosing plate and the display plate and enclosing it therebetween by securing the display plate directly to the shell while the enclosing plate is seated on the recessed ledge;

wherein the first item is viewable through the transparent portion of the shell and the second item is viewable through the display plate.

10. The method of constructing the keepsake display as claimed in claim 9, wherein the step of securing the display plate to the front face of the shell includes the step of adhering edges of the display plate to the front face of the shell.

11. The method of constructing the keepsake display as claimed in claim 10, including the step of using double-sided tape to secure the display plate to the front face of the shell.

* * * * *